US005918436A

United States Patent [19]

Alderman

[11] Patent Number: 5,918,436

[45] Date of Patent: Jul. 6, 1999

[54] RADIANT BARRIER FACING MATERIAL

[76] Inventor: Robert J. Alderman, 686 Highland Ter., Canyon Lake, Tex. 78133

[21] Appl. No.: 08/889,225

[22] Filed: Jul. 8, 1997

[51] Int. Cl.[6] ..... E04B 1/74

[52] U.S. Cl. ..... 52/407.3; 52/406.2; 52/407.5; 52/404.1

[58] Field of Search ..... 52/404.1, 407.3, 52/406.1, 406.2, 407.5; 428/172, 192, 77

[56] References Cited

U.S. PATENT DOCUMENTS

| | | | |
|---|---|---|---|
| 2,616,529 | 11/1952 | Macdonald . | |
| 3,979,537 | 9/1976 | Troyer | 428/61 |
| 4,047,345 | 9/1977 | Alderman | 52/404.1 |
| 4,300,322 | 11/1981 | Clark | 52/406 |
| 4,303,713 | 12/1981 | Clemensen et al. | 428/121 |
| 4,391,075 | 7/1983 | Musgrave | 52/404.1 |
| 4,475,327 | 10/1984 | O'Regan et al. | 52/404 |
| 4,476,659 | 10/1984 | Player | 52/404 |
| 4,724,651 | 2/1988 | Fligg | 52/743.1 |
| 4,726,985 | 2/1988 | Fay et al. | 428/228 |
| 4,972,644 | 11/1990 | Rumiesz et al. | 52/406 |
| 5,001,879 | 3/1991 | Paliwods | 52/309.8 |
| 5,421,133 | 6/1995 | Berdan et al. | 52/404.1 |
| 5,495,698 | 3/1996 | Alderman et al. | 52/742.12 |
| 5,551,203 | 9/1996 | Alderman et al. | 52/746.1 |
| 5,561,959 | 10/1996 | Alderman et al. | 52/407.3 |
| 5,564,250 | 10/1996 | Kessler | 52/741.1 |
| 5,685,123 | 11/1997 | Alderman et al. | 52/749.12 |

OTHER PUBLICATIONS

Rexam Product Data Sheet, Date Unknown.
Lamtec® Corporation Product Data Sheet, Oct. 1995.
VyTech Industries Incorporated Product Data Sheet, Date Unknown.

*Primary Examiner*—Beth Aubrey
*Attorney, Agent, or Firm*—Thomas, Kayden, Horstemeyer & Risley

[57] ABSTRACT

An insulating facing material in accordance with the present invention may include at least two longitudinal sheets formed from a flexible, foldable material that is suitable for coiling for storage purposes. In a preferred embodiment, each sheet includes two substantially parallel longitudinal edges disposed between first and second ends, wherein the longitudinal sheets are arranged on top of one another such that the longitudinal edges of each sheet overlap one another. At least one sheet in the facing material includes at least one fold disposed therein, wherein each fold allows a folded sheet to expand and have a greater area than that of an adjacent sheet, thereby allowing an air gap to form between adjacent sheets. The backing may also include an attaching mechanism for attaching overlapping longitudinal edges of each sheet to one another. One or more sheets within the facing material may include a reflective foil layer disposed on at least one surface thereof for reflecting radiant energy to contribute to the insulating effect of the air gap. The inventive facing may comprise a backing attached to a fiber glass layer.

34 Claims, 2 Drawing Sheets

RADIANT BARRIER FACING MATERIAL

FIELD OF THE INVENTION

The present invention relates generally to insulating devices. More specifically, the present invention relates to a radiant barrier facing material providing a heat transfer barrier within a structure.

DESCRIPTION OF THE PRIOR ART

FIG. 6 illustrates a typical prior art insulation device 40. Device 40 generally includes a fiberglass layer 30 attached to a standard backing or facing 32. Facing 32 may include a foil layer on a side opposite the side attached to the insulation for providing added radiant energy reflective properties, thus adding to the insulating value of device 40. Insulating devices of the type illustrated in FIG. 6 include many disadvantages. For example, the facing provides only limited insulating value and primarily provides support to the fiberglass insulation and a means for attaching the fiberglass insulation to surrounding structures, such as studs in walls, joists in ceilings, rafters in residential roofs or purlins in commercial roofing systems. Furthermore, if the facing lies adjacent to some other solid structure within a building, it often provides for a path for conductive heat transfer. Moreover, reflective surfaces bonded to facings of insulation often become laden with dust, which decreases reflectivity and the insulating value of the material. Finally, the facing has limited strength and often rips during installation, making the installation process both cumbersome and time consuming.

With the forgoing disadvantages of the prior art in mind, it is an object of the present invention to provide a facing system which has multiple layers to provide added strength to an insulating system.

It is another object of the present invention to provide a multiple layer facing system which includes air gaps between the layers to reduce a conductive heat transfer value associated with the backing.

It is another object of the present invention to provide for layers within a facing system which include folds for allowing the one layer within the backing system to have a greater surface area than an adjacent layer so that air gaps form therebetween.

Other objects, features and advantages of the present invention will become apparent upon reading the following specification, when taken in conjunction with the accompanying drawings.

SUMMARY OF THE INVENTION

Generally speaking, the present invention relates to an insulating device which limits radiant, convective and conductive heat transfer between the inside and outside portions of a building structure such as a roof or wall.

More specifically, the present invention relates to an insulating facing material adapted to be fastened between substantially parallel members and inward of a sheathing material. The facing material may include at least two longitudinal sheets formed from a flexible, foldable material. In a preferred embodiment, each sheet includes two substantially parallel longitudinal edges disposed between first and second ends, wherein the longitudinal sheets are arranged on top of one another such that the longitudinal edges of each sheet overlap one another.

At least one sheet in the facing material includes at least one fold disposed therein, wherein each fold allows a folded sheet to expand and have a greater area than that of an adjacent sheet, thereby allowing an air gap to form between adjacent sheets. The backing may also include attaching means for attaching overlapping longitudinal edges of each sheet to one another. The attaching means may comprise virtually any device for attaching the edges, but a preferred embodiment utilizes glue for its ease of application in a manufacturing environment.

In a preferred embodiment of the present invention, at least one fold is disposed in a substantially parallel relationship with the longitudinal edges of a sheet. Although not required, the facing may include at least two folds disposed on a single sheet for providing greater sheet surface area than that of an adjacent sheet. Furthermore, one or more sheets within the facing material may include a reflective foil layer disposed on at least one surface thereof for reflecting radiant energy to contribute to the insulating effect of the air gap. The flexible sheets comprising the facing may include any flexible, foldable sheet-like material that is suitable to be coiled for storage purposes. In a preferred embodiment the flexible sheets may be formed from a paper material.

The facing material may enjoy use in any number of insulating environments. For example, the facing material may insulate a wall between adjacent studs, wherein the longitudinal edges are adapted to receive fastening means for fastening the facing material to studs. Alternatively, rafters or joists of a framed structure may receive the inventive facing material. In a preferred embodiment, the inventive facing material is adapted to be fastened at its longitudinal edges to parallel purlins which support roofing material, and wherein the facing material is disposed in spaces between the purlins and beneath the roofing material. Alternatively, the inventive facing material may be stretched or positioned perpendicular to the purlins or other longitudinal members that provide support to the facing to form a continuous piece across the longitudinal members.

In a preferred embodiment where the facing serves as an insulating material in a horizontal or pitched roof structure, the force of gravity facilitates the opening of the folds to expand the area of folded sheets. In another embodiment, an installer may fill the inventive facing material with air to expand the spaces between sheets.

Finally, the facing structure made in accordance with the present invention may comprise an integral portion of an insulation for use in commercial and residential use. For example, the inventive facing structure may actually comprise a facing attached to a fiber glass layer. The air gap formed between the multiple sheets of the facing may add to the insulating value of a six (6) or eight (8) fiberglass layer attached thereto. Of course, the facing which comprises the folded sheets may also include a foil layer on a side of the facing opposite the fiberglass layer to enhance the insulating value of the system. As is the case with normal insulating material, the backing, whether alone or in combination with a layer of insulation, may be coiled into rolls for storage before application to a structure to be insulated.

The facing structure made in accordance with the present invention may comprise an integral layer of a foam board insulation. For example, a polymer foam board such as polystyrene may include the inventive facing structure laminated thereto. Obviously, the various layers of the facing may include a foil layer on one or both sides to enhance the insulating value of the entire system. In this embodiment, the sheets having the inventive facing material are arranged and configured for a stacking configuration during storage, wherein the facing material folds, wrinkles, or clumps in the manner described above during storage and before expansion of the spaces between layers.

BRIEF DESCRIPTION OF THE DRAWINGS

The accompanying drawings incorporated in and forming a part of the specification illustrate several aspects of the present invention, and together with the description serve to explain the principles of the invention. In the drawings like numerals illustrate like parts throughout the several views.

FIG. 5(*b*) illustrates the insulation board system of FIG. 5(*a*) with the inventive facing system in an expanded configuration.

Figure 1:
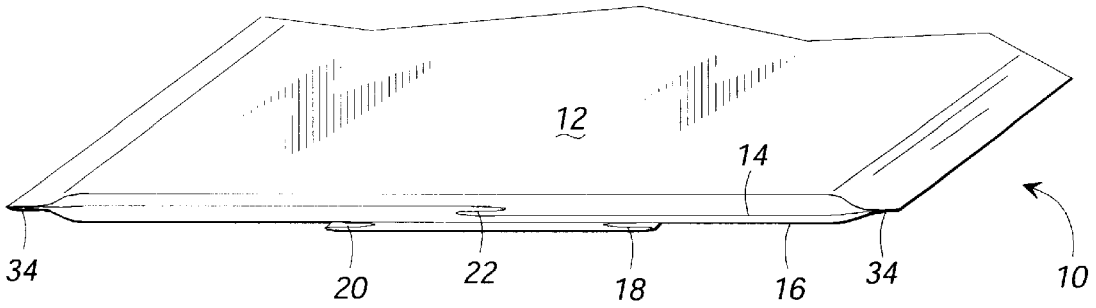
FIG. 1 illustrates a perspective view of a folded facing material in accordance with the present invention.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

DETAILED DESCRIPTION OF THE INVENTION

FIG. 1 illustrates a multilayered facing system 10 constructed in accordance with the present invention. Although facing system 10 may include any number of layers to accomplish the purposes of the present invention, the particular embodiment shown herein comprises three-layered facing beginning with inside layer 12, intermediate layer 14, and outer layer 16. Each layer may consist of virtually any material that is capable of being foldable, creased and rolled into a coil. Examples include, but are not limited to paper, cardboard, synthetic materials such as plastic or composite materials having a mixture of components to maximize strength and insulating properties. Additionally, outer layer 16 may also include a side having a metallic coating or foil layer secured thereto for increasing the reflective insulating property of facing and thereby increasing the overall insulating value of the entire insulating system. Finally, the facing system 10 includes means for attaching the layers 12, 14 and 16 together at peripheral, lateral edges thereof. Although an attaching means may comprise virtually any device, glue is the device of choice because of its ease of application within a production line of a manufacturing facility. Additionally, glue provides an air tight seal at the lateral edges for reducing convective heat transfer between layers of the facing system 10. Other fastening means may include heat sealing lateral edges of the various layers using a hot iron device to fuse multiple layers together.

Intermediate layer 14 includes a fold 22, which forms a critical element of the present invention. Other critical elements of the present invention are folds 18 and 20 in outer layer 16. The folds in layers 14 and 16 serve the unique purpose of differing the surface areas of adjacently placed layers. They also allow the entire facing material to lie in a flat configuration to facilitate stacking or coiling of the facing when in storage after manufacturing and before installation. However, the ordinarily skilled artisan will understand that neat, longitudinal folds are not necessary to accomplish the purposes of the present invention. For example, layers 14 and 16 may simply be wrinkled or wadded after their longitudinal edges are fastened to layer 12. Of critical importance here is that the adjacent layers have a progressively larger width, and consequently, a greater surface area to create the above-referenced air gaps.

Figure 2:
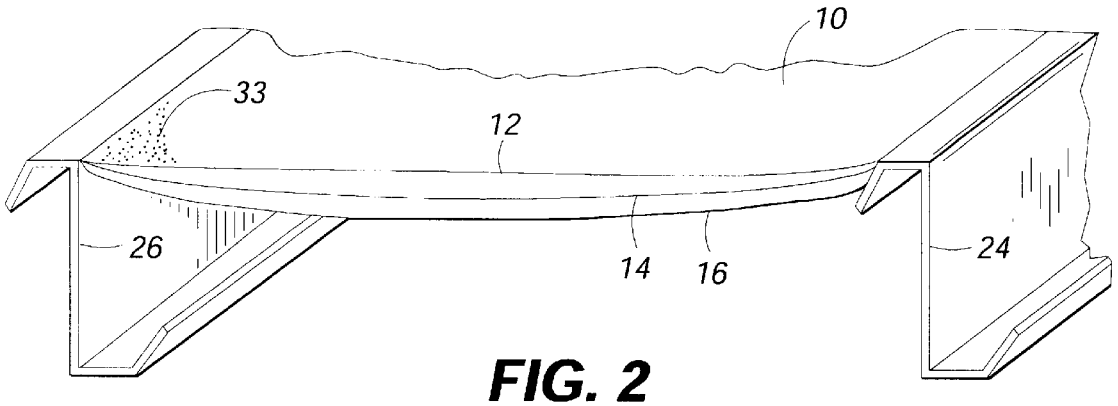
FIG. 2 illustrates a perspective view of the folded facing material in an expanded mode when fastened between adjacent purlins.

FIG. 2 illustrates the backing system when installed within a flat roof in a commercial building. More specifically, FIG. 2 illustrates system 10 with its lateral edges fastened to top portions of purlins 24 and 26. Purlins, such as the ones illustrated in FIG. 2, generally rest upon and run perpendicular to girders which comprise a structure for a commercial building. The purlins are spaced apart and run generally parallel to one another and generally support roof paneling systems on top portions thereof. FIG. 2 illustrates with detail the spaces which form between layers 12, 14 and 16. When the space between adjacent purlins accepts the backing therebetween, the force of gravity pulls layers 14 and 16 into a downward direction, opening folds 18, 20 and 22, thereby creating the spaces between layers 12 and 14 and layers 14 and 16.

As is illustrated in FIG. 2, layers 12 and 14 may include perforations 33 for allowing expansion between layers and for preventing condensation of water between layers. For example, perforations are large enough to allow air to penetrate the between layers 12 and 14 and layers 14 and 16 for expansion, but are smaller than most dust particles, so as to preserve the reflective foil surface between layers. The layers also allow water to evaporate from the spaces between layers, in the event that water condenses between layers.

Alternatively, installers may open small holes for the purpose of allowing adjacent layers to separate. The installers may subsequently seal the holes after installation with vinyl patches, tape or other equivalent means. After installation, it is also important to note that installers may fold over and/or seal ends of the facing material after installation to form a complete seal which is consistent with sealing on the lateral edges of the facing material. Sealing ends of the facing system prevents dust and other particles from entering the facing system between layers to decrease the reflectivity and overall insulating value of the facing material.

Figure 3:
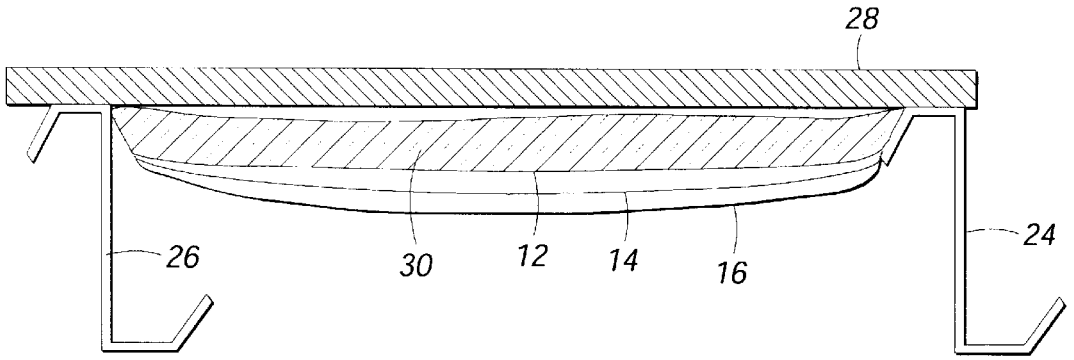
FIG. 3 illustrates a cross-sectional view of an alternative embodiment of the present invention wherein the inventive facing comprises the backing for an insulating material.

FIG. 3 illustrates an entire insulating system disposed between adjacent parallel purlins 24 and 26. Although FIG. 3 illustrates the inventive insulating system disposed between purlins, the ordinarily skilled artisan will recognize that the inventive system may be deployed within a number of structures, including but not limited to joists, studs or rafters in a residential or commercial building environment. In the particular environment illustrated in FIG. 3, upper horizontal portions of purlins 24 and 26 engage and support a bottom surface of a sheet of roofing material 28 above the insulating material. Purlins 24 and 26 receive support from a series of parallel girders which are orientated in a direction which is perpendicular to that of purlins 24 and 26. As is seen in FIG. 3, the force of gravity pulls layers 14 and 16 away from inside layer 12 within the facing to open each of the folds illustrated in FIG. 1 to create the various spaces therebetween. As discussed above, those spaces provide additional insulating value to the overall system. Furthermore, the backing itself may comprise the insulation system without the fiberglass layer attached thereto. Moreover, the ordinarily skilled artisan will recognize that the facing system may also provide a supplement to polymer foam sheet insulation systems.

As discussed above, the material which forms the facing should be readily foldable, creasable, and capable of being rolled into a coil for storage. In a preferred embodiment, layers comprising the facing may consist of a reinforced paper which is normally utilized in fiberglass insulation systems. However, the ordinarily will recognize that virtually any material which satisfies the above-referenced performance requirements may comprise the inventive facing system. Additionally one, two or all of the layers within the facing system may include a foil layer thereon to facilitate radiant energy reflection. Furthermore, the foil layer may exist on only one side or both sides of each layer.

In a preferred embodiment, layer 16 may comprise a non-perforated white vinyl or polypropylene (polymer) material on its bottom side with a foil layer laminated on top of the polymer. More specifically, the material may comprise a flame resistant vapor retardant material consisting of a vinyl film and metallized substrate (foil) laminated to a fiberglass scrim reinforcement. The white polymer of the polymer-scrim-foil (PSF) layer comprises a highly reflective, aesthetically pleasing lower most surface on an inside portion of a commercial building. Layers 12 and 14 may each comprise a foil-scrim-foil (FSF) material which includes a first layer of foil, one layer of scrim laminated to the first layer of foil and a second layer of foil laminated to an opposite side of the scrim. In the insulation material art, scrim generally comprises a fiberglass webbing material having web dimensions ranging from approximately 0.25 inches to approximately 4.0 inches. Thus, in a preferred embodiment, there may be a total of five (5) layers of foil to contribute to a high insulating value for the multilayered facing system. Alternatively, layers 12 and 14 may comprise only foil to reduce material costs associated with the facing system. As another alternative, layers 12, 14 and 16 may each comprise a white polypropylene or vinyl film. As yet another alternative, each of layers 12, 14 and 16 may each comprise a foil layer laminated to the polymer film as foil-polymer (FP) or foil-polymer-foil (FPF) laminates. The inventive facing includes foil or a white polymer film for their reflective properties and, consequently, their low heat emissivity. Where the inventive facing enjoys use as a portion of a roofing structure in warm weather, the reflective properties of the foil reflect heat away from the main building structure and reduce the amount of heat radiated into the building due to the low heat emission properties of the facing. Furthermore, where a building is heated and the environment is colder than the desired inside temperature, the facing structure may then conserve heat energy by reflecting it back into the building. Finally, the low heat emission property of the facing prevents the emission of heat from a warm interior building space to the cooler atmosphere, during cold weather conditions.

VyTech Industries Incorporated, having an address of PO Box 5288 Pearman Dairy Road, Anderson, S.C. 29623 and Lamtec Corporation having an address of PO Box 37, Bartley-Chester Road, Flanders, N.J. 07836-0037 each manufacture the foil, scrim, polymer film, FP, FPF, and FSF material described above.

Figure 4:
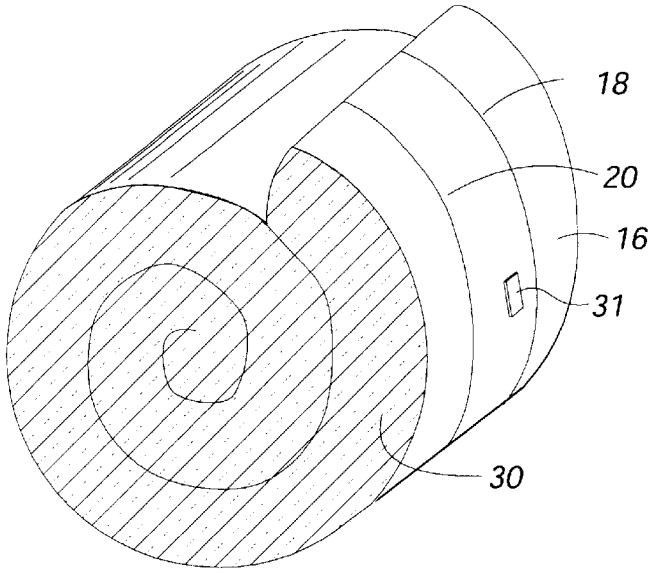
FIG. 4 illustrates the inventive facing and insulation material in a coiled configuration.

FIG. 4 illustrates the facing system integrated into a standard type of fiberglass insulation in a coiled configuration. Outer layer 16 includes creases 18 and 20 which appear as seams on an outer surface thereof. Fiberglass insulating material 30 is attached or laminated to one surface of layer 12 within the facing system. Additionally, outer layer 16 may also include a foil layer on an outer surface thereof for reflecting radiant energy and for promoting the overall insulating value of the insulating system, as discussed above. Finally, if the force of gravity is not sufficient to open the layers to form gaps therebetween, or if the facing system is installed in sloped or vertical environment, tabs 31 disposed on an outer face of the facing may provide a gripping means for the installer to separate the various layers to form the air gaps therebetween. For the purposes of the present invention layers 12, 14 and 16 of the embodiment disclosed in FIG. 4 may be identical to that of the layers of the facing disclosed in FIGS. 1 and 3. However, in a preferred embodiment layer 12, which is laminated to the fiberglass insulation 30 may comprise a kraft (paper-like material) and a metallized substrate (foil) laminated to a scrim fiberglass reinforcement. The insulation layer 30 receives the kraft portion of the kraft-scrim-foil (KSF) laminate via any standard adhesive means known to the ordinarily skilled artisan. The ordinarily skilled artisan may obtain the KSF laminate from the manufacturers listed above. This embodiment may also include the perforations described above preferably in layers 12 and 14. In this embodiment, the fiberglass insulation 30 may serve as a dust filter to prevent small dust particles from entering air spaces between adjacent facing layers.

Figure 5A:
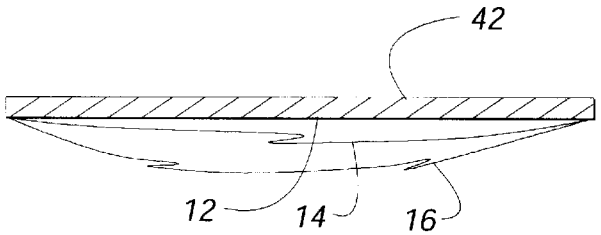
FIG. 5(*a*) illustrates the inventive facing disposed on an insulation foam board structure with the facing in a contracted position.
Figure 5B:
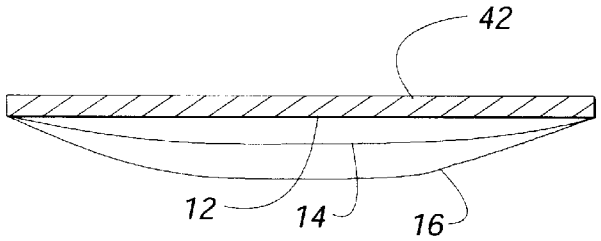
Figure 6:
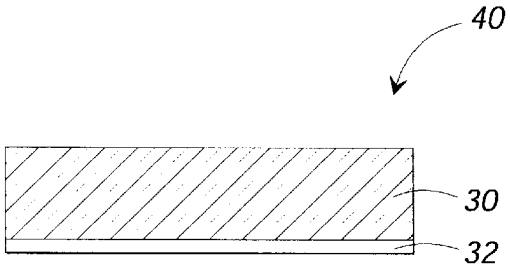
FIG. 6 PRIOR ART
FIG. 6 illustrates a sectional view of a prior art insulating device.

FIGS. 5(*a*) and 5(*b*) illustrate sectional views of the inventive facing system integrated into a standard type of relatively rigid polymer foam board insulation. FIG. 5(*a*) illustrates the facing system in a contracted configuration and FIG. 5(*b*) illustrates the facing system in an expanded configuration. In a manner which is similar to previous embodiments, outer layer 16 includes creases 18 and 20 which appear as seams on an outer surface thereof. The polymer foam board 42 is attached or laminated to one surface of layer 12 within the facing system. Additionally, outer layer 16 may also include a foil layer on an outer surface thereof for reflecting radiant energy and for promoting the overall insulating value of the insulating system, as discussed above. As discussed above, if the force of gravity is not sufficient to open the layers to form gaps therebetween, or if the facing system is installed in sloped or vertical environment, the outermost layer may include pull tabs disposed on an outer face of the facing to a gripping means for the installer to separate the various layers to form the air gaps therebetween. Additionally, the facing at layers 12 or 14 may also include perforations identical to the perforations described in previous embodiments for allowing expansion of spaces between adjacent facing layers. For the purposes of the present invention, layers 12, 14 and 16 of the embodiment disclosed in FIGS. 5(*a*) and 5(*b*) may be identical to that of the layers of the facing disclosed in FIGS. 1 and 3. However, in a preferred embodiment layer 12, which is laminated to the polymer foam board, may comprise a metallized substrate (foil) laminated to the foam board. The ordinarily skilled artisan may obtain the foam board facing materials from the manufacturers listed above.

The foregoing description has been presented for purposes of illustration and description. It is not intended to be exhaustive or to limit the invention to the precise forms disclosed. Obvious modifications or variations are possible in light of the above teachings. For example, virtually any material may comprise the facing system as disclosed, so long as they meet the above-referenced performance parameters. Furthermore, the facing system may include as many or as few layers as necessary, so long as the air spaces are formed between layers. Moreover, the inventive facing system may employ as many or as few air gaps as necessary to achieve the desired insulating properties for a particular application. Additionally, the inventive system may utilize no creases or as many creases, folds, wrinkles or wads as deemed necessary to achieve spacing between facing layers. For example, the area of one layer may simply be greater than an adjacent layer to achieve the air gap. The ordinarily skilled artisan will also recognize that force of gravity is not necessary to open the gap between layers installing the inventive facing system. For example, an installer may separate the layer manually when installing the facing system in either a vertical, sloped or horizontal setting. Therefore, application of the facing system is not limited to horizontal structures. Furthermore, each layer of the system disclosed herein may consist of a kraft film, metallized laminate (foil), polymer film, a FSF laminate, a PSF laminate or a KSF laminate.

The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. An insulating facing material comprising:

at least two longitudinal sheets formed from a flexible, foldable material, each sheet including first and second ends and two substantially parallel longitudinal edges disposed between said first and second ends, said at least two longitudinal sheets each having a respective surface area and being arranged on top of one another such that the longitudinal edges of each sheet overlap one another, the surface area of one of the two sheets being greater than the surface area of the other of the two sheets;

attaching means for attaching said longitudinal edges of each sheet to one another; and an air gap disposed between said at least two sheets, wherein the air gap is formed from the difference in surface areas of said two sheets, the air gap enhancing the insulating value of said facing material.

2. The insulating facing material of claim 1 wherein at least one of said sheets includes at least one fold to form at least one folded sheet, wherein said fold is expandable such that said at least one folded sheet has the greater surface area thereby allowing the air gap to form between the sheets.

3. The insulating facing material of claim 2 wherein said at least one fold is disposed in a substantially parallel relationship with the longitudinal edges of said at least one folded sheet.

4. The insulating facing material of claim 2 wherein said at least one folded sheet includes at least two folds to provide the greater sheet surface area.

5. The insulating facing material of claim 1 further comprising a reflective foil layer disposed on at least one surface of at least one of said sheets which promotes radiant energy reflection and low radiant energy emission therefrom, thereby contributing to the insulating effect of the air gap.

6. The insulating facing material of claim 5 wherein each sheet includes a reflective foil layer disposed on a surface thereof.

7. The insulating facing material of claim 1 wherein at least one of said sheets is composed of a paper material.

8. The insulating facing material of claim 1 wherein said facing material is adapted to be fastened at the longitudinal edges of said facing material to parallel purlins which support roofing material such that said facing material is adapted to be disposed in spaces between the purlins and beneath the roofing material wherein at least a component of the force of gravity facilitates the opening of the gap between said sheets.

9. The insulating facing material of claim 1 further comprising a gripping tab disposed on an outside surface of said facing material which allows an installer to grip the tab and manually separate the sheets of said facing material to create the air gap.

10. The insulating facing material of claim 1 wherein at least one of said sheets is composed of a polymer material.

11. The insulating facing material of claim 1 wherein at least one of said sheets includes perforations therethrough which facilitate expansion of the air gap between said sheets.

12. The insulating facing material of claim 1 wherein said facing material is adapted to be disposed in a non-horizontal position.

13. The insulating material of claim 1 wherein at least one sheet is formed as a foil-scrim-foil laminate.

14. The insulating material of claim 1 wherein at least one sheet is formed from a polymer-scrim-foil laminate.

15. The insulating material of claim 1 wherein at least one sheet is formed from a kraft-scrim-foil laminate.

16. An insulation material comprising:

at least two longitudinal sheets formed from a flexible, foldable material, each sheet including first and second ends and two substantially parallel longitudinal edges disposed between said first and second ends, said sheets each having a respective surface area and being arranged on top of one another such that the longitudinal edges of each sheet overlap one another, the surface area of one of the two sheets being greater than the surface area of the other of the two sheets;

attaching means for attaching said longitudinal edges of each sheet to one another;

an insulating material attached to one of said sheets which enhances the insulating value of the sheets; and an air gap disposed between said sheets, wherein the air gap is formed from the difference in surface areas of said sheets, wherein the air gap provides additional insulating value to the insulation material.

17. The insulation material of claim 16 further comprising at least one fold provided on at least one of said sheets to form at least one folded sheet, wherein the folded sheet is expandable such that said at least one folded sheet has the greater surface area, thereby allowing the air gap to form between said at least one folded sheet and the adjacent sheet.

18. The insulation material of claim 16 wherein said insulating material comprises fiberglass.

19. The insulation material of claim 16 wherein said insulating material comprises substantially rigid polymer foam board.

20. The insulation material of claim 16 wherein at least one fold is formed in at least one of said sheets in a substantially parallel relationship with the longitudinal edges of said at least one sheet.

21. The material of claim 16 further comprising at least two folds formed on at least one of said sheets which provide the greater sheet surface area.

22. The insulation material of claim 16 further comprising:

a reflective foil layer disposed on at least one surface of at least one of said sheets which promotes radiant energy reflection and low radiant energy emission therefrom, thereby contributing to the insulating effect of the air gap.

23. The insulation material of claim 22 wherein each sheet includes a reflective foil layer disposed on a surface thereof.

24. The insulation material of claim 16 wherein said sheets are composed of a paper material.

25. The insulation material of claim 16 wherein said material is adapted to be fastened at the longitudinal edges to parallel purlins which support roofing material wherein said insulation material is adapted to be disposed in spaces between the purlins and beneath the roofing material, and wherein at least a component of the force of gravity facilitates the opening of the gap between said sheets.

26. The insulation material of claim 16 further comprising a gripping tab disposed on an outside surface of said insulation material which allows an installer to grip the tab and separate the sheets of the insulation material to create the air gap.

27. The insulation material of claim 16 wherein at least one of said sheets is composed of a polymer material.

28. The insulation material of claim 16 wherein at least one of said sheets is formed as a foil-scrim-foil laminate.

29. The insulation material of claim 16 wherein at least one of said sheets is formed as a polymer-scrim-foil laminate.

30. The insulation material of claim 16 wherein at least one of said sheets is formed as a kraft-scrim-foil laminate.

31. The insulation material of claim 16 wherein at least one of said sheets includes perforations which facilitate expansion of the air gap between the sheets.

32. The insulation material of claim 16 wherein the insulation material is adapted to be disposed in a non-horizontal position.

33. Insulation material for installation on adjacent purlins of a roof of a building structure, said insulation material comprising:

a blanket of insulating material having opposed parallel blanket side edges and a body portion between said blanket side edges;

at least one sheet of flexible, foldable heat reflective facing material having opposed parallel sheet side edges;

means for connecting said sheet side edges to said blanket side edges with said sheet spanning said blanket body portion;

said sheet characterized by having been folded to form at least one fold along said sheet between said sheet side edges with the at least one fold in juxtaposition with said body portion of said blanket during storage of said insulation material, wherein said fold of said sheet later unfolds to expand said sheet away from said body portion of said blanket to form an air space between said sheet and said blanket when said insulation material is installed on adjacent roof purlins.

34. The insulation material of claim 33, wherein:

said at least one sheet of flexible, foldable heat reflective facing material comprises at least two flexible sheets imposed on one another, with each sheet having a different breadth between the side edges of each sheet for forming a plurality of air spaces between said flexible sheets.

* * * * *